US007170230B2

(12) United States Patent
Takagaki et al.

(10) Patent No.: US 7,170,230 B2
(45) Date of Patent: Jan. 30, 2007

(54) MERCURY-FREE ARC TUBE FOR A DISCHARGE LAMP

(75) Inventors: Michio Takagaki, Shizuoka (JP); Takeshi Fukuyo, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 217 days.

(21) Appl. No.: 11/012,296

(22) Filed: Dec. 16, 2004

(65) Prior Publication Data

US 2005/0134179 A1 Jun. 23, 2005

(30) Foreign Application Priority Data

Dec. 19, 2003 (JP) ..... P. 2003-422002

(51) Int. Cl.
*H01J 61/06* (2006.01)

(52) U.S. Cl. ..... 313/631; 313/331; 313/332; 313/634

(58) Field of Classification Search ..... 313/631, 313/634, 331, 332, 640, 625, 624, 623; 445/23, 445/26, 43, 38
See application file for complete search history.

(56) References Cited

U.S. PATENT DOCUMENTS 5,552,670 A * 9/1996 Heider et al. ..... 313/625

FOREIGN PATENT DOCUMENTS

JP 2001-15067 A 1/2001

* cited by examiner

*Primary Examiner*—Joseph Williams
(74) *Attorney, Agent, or Firm*—Sughrue Mion, PLLC

(57) ABSTRACT

A mercury-free arc tube for a discharge lamp has a closed chamber filled with rare gas and a metal halide containing at least Na halide or Sc halide and electrodes disposed on both end portions of the closed chamber so as to be opposed to each other, wherein the electrode rod is stepped shape which satisfies relationship of 1.1<A1/A2<7.3, whereas A1 is a cross sectional area of the electrode in a top-end side area protruded into the closed chamber and A2 is a cross sectional area of the electrode in a base-end side area fixed to the end portion of the closed chamber.

12 Claims, 7 Drawing Sheets

| $d_1/d_2$ | CRACK OCCURRING RATE (%) | ELECTRODE BREAKAGE OCCURRING RATE (%) |
|---|---|---|
| 1.00 | 1.40 | 0.00 |
| 1.17 | 0.00 | 0.35 |
| 1.20 | 0.45 | 0.00 |
| 1.33 | 0.25 | 0.00 |
| 1.50 | 0.40 | 0.00 |
| 1.67 | 0.45 | 0.40 |
| 1.85 | 0.40 | 0.00 |
| 2.00 | 0.40 | 0.13 |
| 2.19 | 0.45 | 0.20 |
| 2.31 | 0.30 | 0.45 |
| 2.33 | 0.00 | 0.37 |
| 2.50 | 0.00 | 0.40 |
| 2.67 | 0.30 | 0.50 |
| 3.00 | 0.40 | 0.80 |
| 4.00 | 0.00 | 1.60 |

| $A_1/A_2$ | CRACK OCCURRING RATE (%) | ELECTRODE BREAKAGE OCCURRING RATE (%) |
|---|---|---|
| 1.00 | 0.00 | 0.37 |
| 1.00 | 1.40 | 0.00 |
| 1.17 | 0.45 | 0.40 |
| 1.36 | 0.00 | 0.35 |
| 1.44 | 0.45 | 0.00 |
| 1.79 | 0.00 | 0.37 |
| 1.90 | 0.25 | 0.00 |
| 2.09 | 0.40 | 0.43 |
| 2.25 | 0.40 | 0.00 |
| 2.56 | 0.00 | 0.40 |
| 3.02 | 0.45 | 0.40 |
| 3.42 | 0.40 | 0.00 |
| 4.00 | 0.40 | 0.00 |
| 5.54 | 0.30 | 0.45 |
| 5.64 | 0.00 | 0.00 |
| 6.08 | 0.40 | 0.35 |
| 7.11 | 0.30 | 0.50 |
| 8.38 | 0.07 | 1.10 |
| 8.96 | 0.25 | 0.00 |

MERCURY-FREE ARC TUBE FOR A DISCHARGE LAMP

The present invention claims foreign priority to Japanese patent application No. 2003-422002, filed on Dec. 19, 2003, the contents of which is incorporated herein by reference.

BACKGROUND OF THE INVENTION

1. Field of the Invention

The present invention relates to a mercury-free arc tube for a discharge lamp having a closed chamber portion opening portions on both ends of which are sealed, in which Na or Sc halides are sealed together with a rare gas and the electrode rods are provided to oppose to each other, and which has an internal volume of 50 μl.

2. Description of the Related Art

FIG. 11 shows a discharge lamp in the related art. The discharge lamp has such a structure that a front end portion of a quartz-glass arc tube 5 is supported with one lead support 2 protruded forward from an insulating base 1, a rear end portion of the arc tube 5 is supported with a concave portion 1*a* of the base 1, and the arc tube 5 is sustained at a portion near its rear end with a metal supporting member 4 fixed to a front surface of the insulating base 1. A front end-side lead wire 8 led from the arc tube 5 is fixed to the lead support 2 by welding, while a rear end-side lead wire 8 is passed through a bottom wall 1*b* constituting the concave portion 1*a* of the base 1 and secured to a terminal 3 provided to the bottom wall 1*b* by welding. A symbol G denotes a cylindrical ultraviolet shielding globe made of the glass to cut off an ultraviolet component in a bandwidth that is harmful to the human body from the light that is emitted from the arc tube 5. This ultraviolet shielding globe G is deposited integrally to the arc tube 5.

Then, the arc tube 5 has such a structure that a closed glass globe 5*a* in which electrode rods 6, 6 are provided between a pair of front and rear pinch sealed portions 5*b*, 5*b* to oppose to each other and into which luminous substances (Na and Sc halides and Hg) are sealed together with a rare gas is formed. A molybdenum foil 7 for connecting the electrode rod 6 protruded into the closed glass globe 5*a* and the lead wire 8 led from the pinch sealed portion 5*b* is sealed in the pinch sealed portion 5*b*, and thus an air tightness in the pinch sealed portion 5*b* is maintained.

That is, a tungsten electrode rod that is excellent in a heat resistance and durability is most desirable as the electrode rod 6. However, such tungsten has a coefficient of linear expansion that is largely different from that of the quartz glass constituting the arc tube, and gets to badly fit the quartz glass, and is inferior in the air tightness to the quartz glass. For this reason, the air tightness in the pinch sealed portion 5*b* is secured by connecting a molybdenum foil 7 to the tungsten electrode rod 6 and then sealing the molybdenum foil 7 with the pinch sealed portion 5*b*. The molybdenum foil 7 is excellent in elasticity and flexibility and also, it shows relatively well fitting property to the quartz glass.

However, a difference in temperature in the pinch sealed portion 5*b* becomes large when the arc tube 5 is turned ON and OFF. Thus, when the arc tube 5 is turned ON, a thermal stress is generated between the electrode rod and the quartz glass layer, coefficients of linear expansion of which are largely different. In particular, because the recent arc tube is constructed to make the instantaneous lighting possible, a rate of temperature rise is large and the thermal stress is generated abruptly. Then, such a problem existed that, if such situation is repeated many times, a crack appears in the pinch sealed portion which corresponds a quartz glass layer) 5*b* that seals the electrode rod 6 and the sealed substance leaks out, which result in the lightening failure or the shorter lifetime.

With regard to this problem, the structure shown in Japanese Patent Unexamined Publication No. JP-A-2001-15067 which is described below was proposed based on such a conclusion. The conclusion is that, in a case that a residual compressive strain caused in the pinch sealed portion 5*b* in the course of the arc tube manufacturing still remains over predetermined areas, because the thermal stress generated in the quartz glass layer in the pinch sealed portion can be scattered due to the temperature rise when the arc tube is turned ON. Accordingly, the crack is hard to appear in the quartz glass layer in the pinch sealed portion and therefore, the lifetime of the arc tube is extended.

In other words, as shown in FIG. 12, the JP-A-2001-15067 shows such a structure that a residual compressive strain layer 9 is formed on adhesive surfaces which is defined between the quartz glass layer and the electrode rod 6 in the pinch sealed portion 5*b* over a predetermined wide area. Since the thermal stress generated on a boundary between the electrode rod 6 and the quartz glass layer is absorbed and scattered by the residual compressive strain layer 9 and transmitted to the quartz glass layer side, the crack that leads a leakage of the sealed substance is not generated in the quartz glass layer in the pinch sealed portion 5*b*.

Also, this Hg sealed in the closed glass globe 5*a* is a very useful buffer substance to relieve the damage of the electrode by maintaining a predetermined tube voltage and reducing an amount of collision of the electron to the electrode. However, such Hg is an environmentally hazardous material. For this reason, recently the development of the so-called mercury-free arc tube into which Hg acting as the environmentally hazardous material is not sealed is accelerated.

When the mercury-free arc tube is employed, the tube voltage is lowered and the tube power necessary for a discharge cannot be achieved. Therefore, an electric current supplied to the arc tube, which is called tube current, must be increased to increase the tube power, and a load to the electrode is increased correspondingly. As a result, such a problem has arisen that the electrode is damaged which is represented by occurring (consumption or darkened, and either reduction in the luminous efficiency or disappearance of the arc is brought about. To deal with this problem, it may solve the problem by enlarging the diameter of the electrode rod 6. However, if the diameter of the electrode rod 6 is enhanced too thick, a difference in a thermal compression amount between the electrode rod and the quartz glass layer appears largely in cooling the pinch sealed portion after the pinch sealing is applied. Then separation of the boundary between the quartz glass layer and the electrode rod is caused. Thus, the residual compressive strain layer 9 having a size enough to absorb and relieve the thermal stress, which is generated when the arc tube is turned ON, cannot be formed in the quartz glass layer of the pinch sealed portion 5*b* around the electrode rod 6. Such anew problem has arisen that the crack that leads a leakage of the sealed substance is generated in the pinch sealed portion 5*b* when the arc tube is turned ON and OFF.

SUMMARY OF THE INVENTION

Therefore, the inventors of the present invention concluded that a top end-side outer diameter of the electrode rod 6 arranged in the closed glass globe 5*a* should be increased and a base end-side outer diameter of the electrode rod 6 sealed in the pinch sealed portion 5*b* should be decreased. Then, the inventors trially manufactured various stepped electrode rods having different outer diameters in a top end-side area and a base end-side area respectively. Then considered an occurring rate of the damage (consumption or darkening) of the electrode and an occurring rate of the crack in the pinch sealed portion based on the experiments. At that time, it was confirmed that the conflicting problem between the damage of the electrode and the generation of the crack can be overcome by forming the shape of the electrode rod into such stepped shape, whereby the inventors came to propose the present invention.

The present invention has been made in view of the problems in the related art and based on the findings of the inventors. It is an object of the present invention to provide a mercury-free arc tube for a discharge lamp in which electrodes are not damaged and no crack is generated in a sealed portion by a change in thermal stress when the arc tube is turned ON and OFF.

In order to achieve the above object, according to a first aspect of the present invention, it is provided a mercury-free arc tube for a discharge lamp, comprising:

a closed chamber filled with rare gas and a metal halide containing at least Na halide or Sc halide, an internal volume of the closed chamber being 50 μl or less; and electrodes disposed on both end portions of the closed chamber so as to be opposed to each other, wherein the electrode rod is step-shaped which satisfies relationship of $1.1<A1/A2<7.3$, whereas A1 is a cross sectional area in a top-end side area protruded into the closed chamber, and A2 is a cross sectional area in a base-end side area fixed to the end portion of the closed chamber.

According to a second aspect of the present invention according to the first aspect of the present invention, it is preferable that a length of the top-end side area of the electrode rod is ranging from 1.0 to 2.0 mm.

According to a third aspect of the present invention according to the first aspect of the present invention, it is more preferable that the electrode rod is stepped coaxial cylindrical shape in which a ratio (d1/d2) of an outer diameter (d1) in the top-end side area to an outer diameter (d2) in the base-end side area is ranging from 1.2 to 2.7.

According to a fourth aspect of the present invention according to the first aspect of the present invention, it is further preferable that the arc tube is made of quartz glass, the closed chamber is sealed on pinch sealed portions, and the closed chamber is a closed glass globe.

According to a fifth aspect of the present invention according to the fourth aspect of the present invention, it is furthermore preferable that a molybdenum foil is fixed and sealed to the pinch sealed portion, and the molybdenum foil has:

a first end side connected to the base-end side area of the electrode rod; and a second end side connected to a lead wire extracted from the pinch sealed portion.

According to a sixth aspect of the present invention according to the first aspect of the present invention, it is suitable that the arc tube is made of translucent ceramic, and the closed chamber is a closed ceramic tube cylinder.

According to a seventh aspect of the present invention according to the first aspect of the present invention, it is more suitable that a cross sectional shape of the top-end side area of the electrode rod is substantially circle.

According to an eighth aspect of the present invention according to the first aspect of the present invention, it is further suitable that a cross sectional shape of the base-end side area of the electrode rod is substantially circle.

According to a ninth aspect of the present invention according to the first aspect of the present invention, it is furthermore suitable that a cross sectional shape of the base-end side area of the electrode rod is rectangular-like shape which is obtained by cutting off at least a part of a circle.

According to a tenth aspect of the present invention according to the first aspect of the present invention, it is desirable that a boundary portion defined between the top-end side area and the base-end side area of the electrode is step-shaped.

According to an eleventh aspect of the present invention according to the first aspect of the present invention, it is more desirable that a boundary portion defined between the top-end side area and the base-end side area of the electrode is taper-shaped.

According to a twelfth aspect of the present invention according to the first aspect of the present invention, it is further desirable that a boundary portion defined between the top-end side area and the base-end side area of the electrode is slope-shaped.

Here, the "stepped shape" is not limited to the shape whose level difference portion between the top-end side area and the base-end side area is formed as a rectangular shape, as shown in the embodiment, and contains various shapes such as a tapered shape or a sloped shape in which a level difference is gradually changed.

In this case, as the arc tube, there are such a structure that, as shown in the fourth aspect of the present invention, the arc tube is made of quartz glass, the sealed portions are formed as pinch sealed portions, and the closed chamber is formed as a closed glass globe, and such a structure that, as shown in the sixth aspect of the present invention, the arc tube is made of translucent ceramic and the sealed portion is consists of a molybdenum pipe that is assembled integrally with an outer periphery in the base-end side area of the electrode rod by welding and a metallize layer filled between an outer peripheral surface of the molybdenum pipe and an inner peripheral surface of a ceramic tube, for example.

(Effect) According to the first aspect of the present invention, the electrode in the closed chamber which corresponds the top-end side area of the electrode rod has a larger heat capacity of the electrode if its cross sectional area becomes larger, and thus the damage of the electrode such as consumption, darkening, or the like of the electrode is lessened correspondingly. Therefore, such electrode rod can fulfill sufficiently mercury-free arc tube specifications. In the specification, the tube current is increased to compensate reduction in the tube voltage. However, if its cross sectional area is set too large, the heat capacity of the electrode becomes too large and then consumption of the thermal energy in the top end portion of the electrode is increased, and thus consumption as an optical energy, i.e., an energy efficiency is lowered. It is impossible to say simply that its cross sectional area should be set large. As a result, an upper limit of the cross sectional area in the top-end side area of the electrode rod is given as an area ($0.04\pi$ $mm^2$) that is equivalent to an upper limit 0.4 mm of an outer-diameter dimension standard of the electrode for the arc tube of this type, for example.

In contrast, from the viewpoint of preventing generation of the crack in the pinch sealed portion as the sealed portion of the quartz-glass arc tube, for example, it is desired that the cross sectional area in the base-end side area of the electrode rod should be set small.

More particularly, the cross sectional area in the base-end side area of the electrode rod have an influence upon formation of a residual compression strain layer in the pinch sealed portion around the base-end side area of the electrode rod. In other words the residual strain layer is effective to relieve and absorb a thermal stress that leads the crack generation. Such formation is insufficient if the cross sectional area is large, while such formation is made surely if the cross sectional area is smaller. This mechanism will be explained below.

A stress is not generated on the boundary between the glass layer and the electrode rod immediately after the pinch sealing is applied. But the stress that corresponds to a different in the coefficients of liner expansion of both materials i.e., a tensile stress on the electrode rode side, a compressive stress on the quartz glass side, acts on the boundary between the electrode rod (tungsten) and the glass (quartz glass) when the pinch sealed portion returns to an ordinary temperature. Thus, the pinch sealed portion is in such a mode as it is that the stress still remains to some extent. I.e., a residual tensile strain remains in the electrode rode, and a residual compressive strain remains in the quartz glass layer. Then, when turned ON, a temperature of the arc tube does not increase up to a temperature attained when the pinch sealed portion is pinch-sealed. As a result, in the case where the residual compressive strain layer is formed in the quartz glass layer over the wide range, the thermal stress generated in the quartz glass layer of the arc tube, when turned ON, acts to lower the compressive strain, which remains in advance in the glass layer of the pinch sealed portion when the arc tube is turned OFF, in both axial and circumferential directions.

In this manner, the thermal stress (tensile thermal stress) to relax this residual compressive strain acts to the quartz glass layer in the pinch sealed portion when the arc tube is turned ON. Therefore, if the residual compressive strain layer is formed in the wide range around the electrode rod, such residual compressive strain layer relieve and absorb effectively the thermal stress that is generated in the quartz glass layer with the temperature rise because the arc tube is turned ON. In other words, because the thermal stress generated repeatedly is absorbed and scattered by the residual compressive strain layer, which exists over the wide range, and then transmitted to the quartz glass layer side, no crack leading to the leakage of the sealed substance is generated in the quartz glass layer.

Therefore, it is desired that the residual compressive strain layer should be formed in the wide range around the base-end side area of the electrode rod. In this case, if the cross sectional area of the electrode rod in the base-end side area is too large, a difference in an amount of thermal contraction between the electrode rod and the quartz glass layer largely appears in the course of cooling of the pinch sealed portion after pinch sealing was applied, and thus the quartz glass layer is separated from the electrode rod at the boundary. Accordingly, the residual compressive strain layer is not formed in the wide range and then the thermal stress generated at the boundary between the electrode rod and the quartz glass layer when the arc tube is turned ON cannot be sufficiently absorbed. As a result, it is desired that the cross sectional area in the base-end side area of the electrode rod should be set small because the residual compressive strain layer can be formed without fail to prevent the generation of the crack.

Also, there are correlations as shown in FIGS. 6A and B between an area ratio A1/A2 of the cross sectional area A1 in the top-end side area of the electrode rod to the cross sectional area A2 in the base-end side area of the electrode rod and a crack occurring rate and an electrode breakage occurring rate. That is, the electrode breakage occurring rate is increased if the ratio A1/A2 is increased, while the crack occurring rate is increased if the ratio A1/A2 is decreased. Therefore, it is desired that the ratio A1/A2 should be set in a range of 1.1 to 7.3 within which the crack occurring rate and the electrode breakage occurring rate are suppressed below 0.5%.

Also, in the ceramic arc tube, as shown in FIG. 10, a molybdenum pipe 24 to which an electrode rod 14D is welded integrally is inserted into a ceramic tube 22, and then opening portions of the ceramic tube 22 are sealed with a metallized layer 25 filled between the molybdenum pipe 24 and the ceramic tube 22.

Then, if the cross sectional area of the electrode rod becomes larger, an amount of thermal expansion in the base-end side area of the electrode rod becomes large when the arc tube is turned ON. Thus, the thermal stress acting on the ceramic tube 22 via the molybdenum pipe 24, a welded portion 26, and the metallized layer 25 is also increased, and the crack is ready to occur in the ceramic tube 22 correspondingly.

Therefore, in the ceramic arc tube, it is desired that the cross sectional area in the base-end side area of the electrode rod should be set small. The condition, which is the ratio A1/A2 being in the range of 1.1 to 7.3, similar to the quartz-glass arc tube is available.

According to the second aspect of the present invention, as shown in FIG. 4, if a length L of the top-end side area of the electrode rod exceeds 2.0 mm, the heat capacity of the electrode becomes too large and then consumption of the thermal energy is increased correspondingly in the top end portion of the electrode. Thus, the energy consumption as an optical energy, i.e., the energy efficiency (lumen/watt) is abruptly lowered. In contrast, if the length L of the top-end side area of the electrode rod is below 1.0 mm, the temperature of the electrode rises excessively because the heat capacity of the electrode is small. Thus the electrode is consumed largely or the breakage is caused at the stepped portion of the electrode rod. As a result, it is desired that the length L of the top-end side area of the electrode rod should be set in a range of 1 to 2 mm in which the energy efficiency in excess of about 90 lumen/watt close to the maximum efficiency can be assured and the electrode is not damaged.

According to the third aspect of the present invention, like the area ratio A1/A2 of the cross sectional area A1 in the top-end side area of the electrode rod to the cross sectional area A2 in the base-end side area of the electrode rod, there are correlations between a dimensional ratio d1/d2 of the outer diameters d1, d2 in the top-end side area of the electrode rod and the base-end side area of the electrode rod and a crack occurring rate and an electrode breakage occurring rate (see FIGS. 3A and 3B). That is, the electrode breakage occurring rate is increased if the ratio d1/d2 is increased, while the crack occurring rate is increased if the ratio d1/d2 is decreased. Therefore, it is desired that the ratio d1/d2 should be set in a range of 1.1 to 2.7 in which both the crack occurring rate and the electrode breakage occurring rate are suppressed below 0.5%.

Also, since the electrode rod is shaped into the coaxial circular-cylindrical shape, design of shape of the electrode rod can be made easy.

According to the fifth aspect of the present invention, the molybdenum foil that gets to relatively well fit to the quartz glass is connected to the electrode rod in the pinch sealed portion of the quartz-glass arc tube. Thus, not only the air tightness can be secured in the power feeding path from the lead wire in the pinch sealed portion to the electrode rod but also the generation of the crack can be prevented in the pinch sealed portion.

As apparent from the above explanation, according to the mercury-free arc tube for the discharge lamp according to the present invention, neither the damage of the electrode such as consumption or darkening of the electrode nor the generation of the crack in the sealing portion is caused. Therefore, the mercury-free arc tube for the discharge lamp having a long lifetime can be provided.

According to the second aspect of the present invention, the mercury-free arc tube for the discharge lamp that can attain a high efficiency and is excellent in durability can be provided.

According to the third aspect of the present invention, in the case of the quartz-glass arc tube, when the electrode rod and the molybdenum foil are jointed to each other, the alignment of the electrode rod with the molybdenum foil in the circumferential direction is not needed. Therefore, the step of jointing the electrode rod to the molybdenum foil can be facilitated correspondingly.

Also, in the case of the ceramic arc tube, the manufacture of the molybdenum pipe with which the electrode rod can be engaged can be made easy. Therefore, the manufacture of the ceramic arc tube can be simplified.

According to the fifth aspect of the present invention, in the quartz-glass mercury-free arc tube, generation of the crack in the pinch sealed portion can be prevented without fail. Therefore, the longer lifetime of the mercury-free arc tube can be attained.

DETAILED DESCRIPTION OF THE PREFERRED EMBODIMENTS

Next, embodiments of the present invention will be explained based on examples hereinafter.

Figure 1:
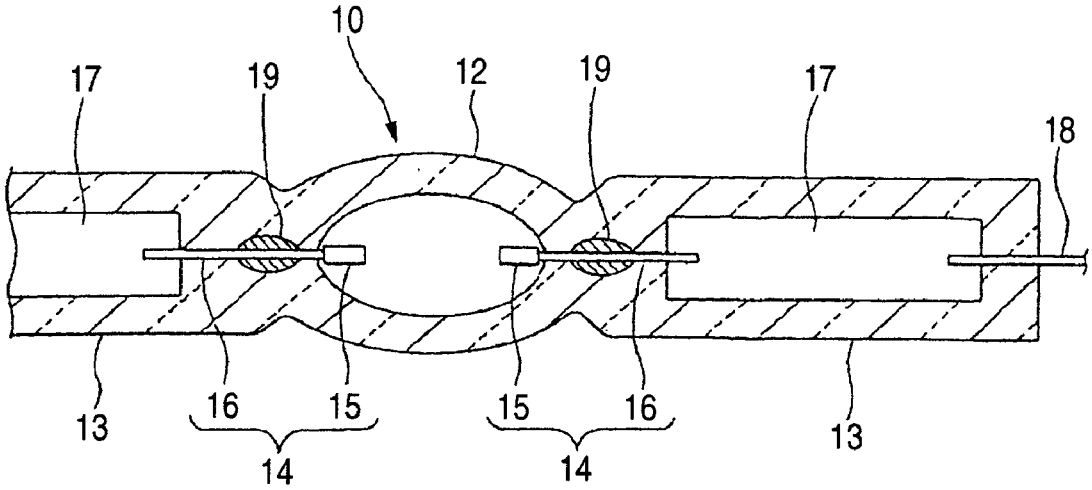
FIG. 1 is a longitudinal sectional view showing a pertinent portion of an arc tube for a discharge lamp as a first embodiment of the present invention.
Figure 2A:
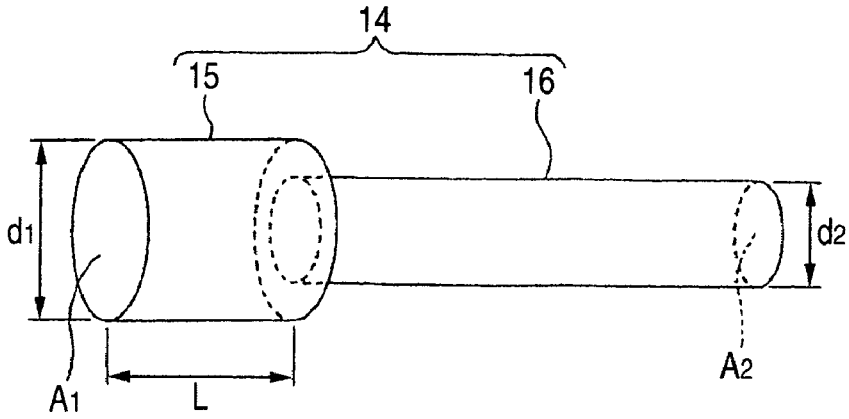
FIG. 2A is an enlarged side perspective view of an electrode rod constituting the arc tube of the first embodiment of the present invention.
Figure 2B:
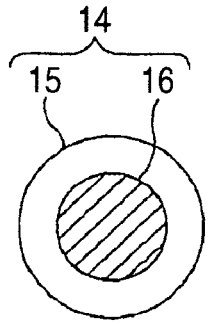
FIG. 2B is a cross sectional view of the same electrode rod of the first embodiment of the present invention.
Figures 3A, 3B:
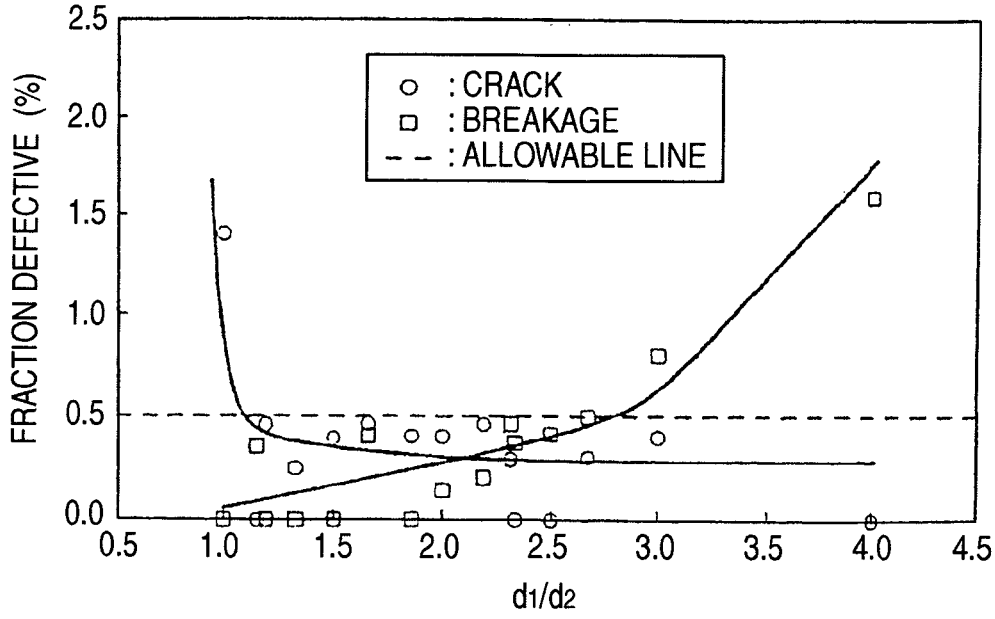
FIG. 3A is a view showing relationships of a crack occurring rate in a pinch sealed portion and an electrode breakage occurring rate to an outer diameter ratio between a top-end side area of the electrode rod and a base-end side area of the electrode rod.
FIG. 3B is a view showing relationships of a fraction defective of the electrode rod to the outer diameter ratio between the top-end side area of the electrode rod and the base-end side area of the electrode rod.
Figure 4:
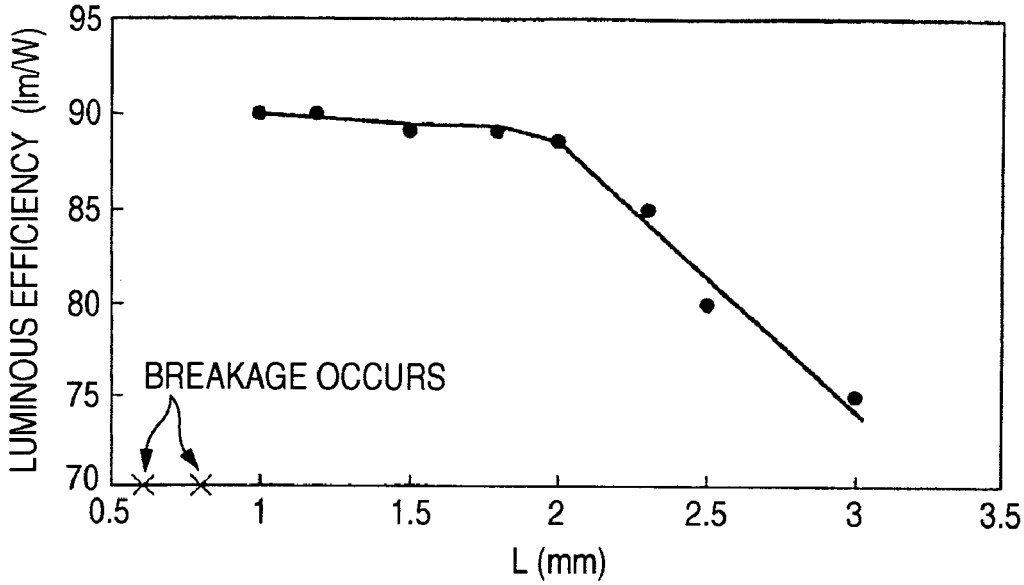
FIG. 4 is a view showing a relationship between a length of the top-end side area of the electrode rod and an efficiency of the arc tube.

FIG. 1 to FIG. 4 show a first embodiment of the present invention. FIG. 1 is a longitudinal sectional view showing an arc tube for a discharge lamp as a first embodiment of the present invention. FIG. 2A is an enlarged side perspective view of an electrode rod constituting the same arc tube, and FIG. 2(*b*) is a cross sectional view of the same electrode rod. FIG. 3A is a view showing relationships of a crack occurring rate in a pinch sealed portion and an electrode breakage occurring rate to an outer diameter ratio between a top-end side area of the electrode rod and a base-end side area of the electrode rod, and FIG. 3B is a view showing relationships of a fraction defective of the electrode rod to the outer diameter ratio between the top-end side area of the electrode rod and the base-end side area of the electrode rod. FIG. 4 is a view showing a relationship between a length of the top-end side area of the electrode rod and an efficiency of the arc tube.

Figure 11:
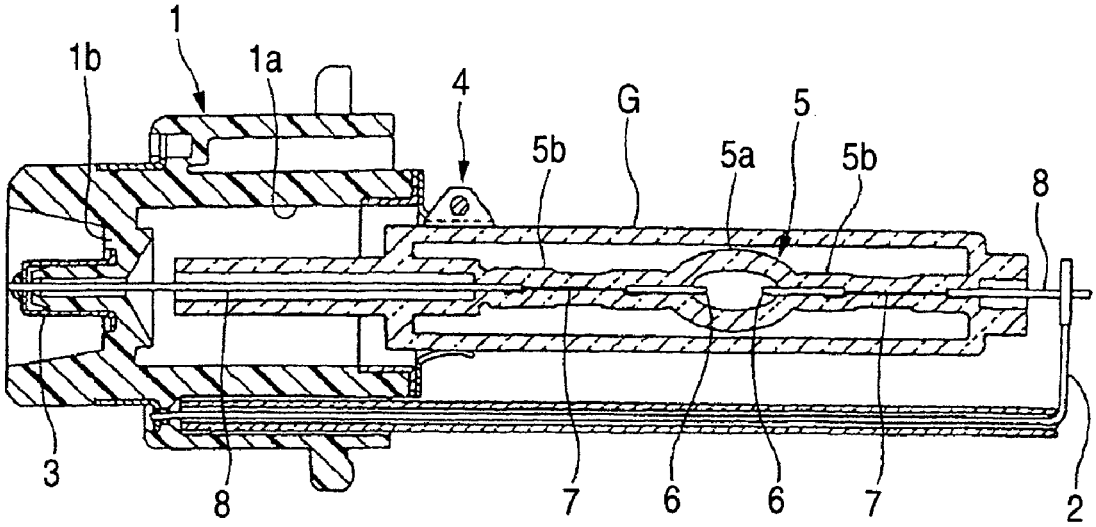
FIG. 11 is a longitudinal sectional view showing the discharge lamp in the related art.

In these Figures, a structure of a discharge lamp into which an arc tube 10 is installed is substantially identical to the conventional structure shown in FIG. 11 except that such discharge lamp is a mercury-free discharge lamp that is operated at a rated power of 35 W, and their redundant explanation will be omitted herefrom.

The arc tube 10 has such a very compact structure that a circular-pipe quartz-glass tube, in which a spherically swollen portion is formed in the middle of its linearly extended portion in the longitudinal direction, is pinch-sealed at both end portions near the spherically swollen portion respectively. Also pinch sealed portions 13, 13 each having a rectangular cross section are formed on both end portions of a chip less closed glass globe 12 that is formed like an elliptic shape or a circular-cylindrical shape to constitute a discharge space whose internal volume is 50 μl or less. Buffering metal halides such as (NaI, $ScI_3$) as the luminous substance and $ThI_4$ instead of the mercury, etc. as well as a starting rare gas e.g., Xe gas are sealed in the closed glass globe 12.

Also, tungsten electrode rods 14, 14 constituting discharge electrodes are provided in the closed glass globe 12 to oppose to each other. The electrode rods 14, 14 are connected to a molybdenum foil 17 that is sealed in the pinch sealed portion 13 respectively, and molybdenum lead wires 18, 18 connected to the molybdenum foils 17, 17 are extended from end portions of the pinch sealed portions 13, 13 respectively.

Figure 12:
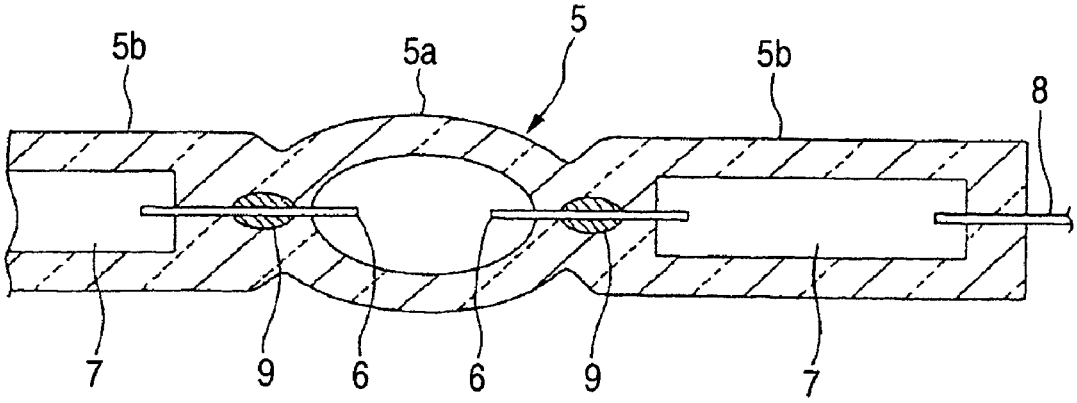
FIG. 12 is a sectional view explaining a pertinent portion in the JP-A-2001-15067.

Also, in the arc tube in the prior art (see FIG. 12) the electrode rods are formed to have a uniform thickness respectively. In contrast, in the arc tube of the present embodiment, a cylindrical top-end side area 15 protruded into the closed glass globe 12 and having an outer diameter d1 and a cylindrical base-end side area 16 sealed in the pinch sealed portion 13 and having an outer diameter d2 which is smaller than d1 are formed like stepped circular cylinders that are continued in a coaxial manner.

In more detail, the top-end side area 15 of the electrode rod in the closed glass globe 12 has a larger heat capacity of the electrode rod if the outer diameter d1 is set larger. Thus, the damage of the electrode rod such as the consumption or darkening of the electrode rod can be reduced correspondingly. Therefore, it is desired that the outer diameter d1 should be set to as large a dimension (e.g., 0.3 to 0.4 mm) as possible within a range that does not exceed an upper limit 0.4 mm of a standard value in an outer diameter dimension as the cylindrical electrode for the arc tube of this type. In this case, if the outer diameter d1 is set too large, the heat capacity of the electrode becomes too large and then consumption of a thermal energy is increased in the top end portion of the electrode. Thus, energy consumption as an optical energy, i.e., an energy efficiency is lowered. But no problem arises unless the outer diameter does not exceed the upper limit 0.4 mm of the standard value as the tungsten electrode for the arc tube.

On the contrary, it is desired that the outer diameter d2 in the base-end side area 16 of the electrode sealed in the pinch sealed portion 13 should be set to as small a dimension (e.g., 0.1 to 0.3 mm) as possible such that a residual compressive strain layer 19 to relieve and absorb the thermal stress, which is generated in the quartz glass layer of the pinch sealed portion 13 when the arc tube is turned ON, can be formed around the base-end side area 16 of the electrode rod over a wide range.

More particularly, no stress is generated on the boundary between the glass layer and the electrode rod immediately after the pinch sealing is applied. But a stress that corresponds to a different in the coefficients of liner expansion of both materials (a tensile stress on the electrode rode side, a compressive stress on the quartz glass side) acts on the boundary between the electrode rod (tungsten) and the glass (quartz glass) when the pinch sealed portion returns to an ordinary temperature. Thus, the pinch sealed portion is in such a mode as it is that the stress still remains (a residual tensile strain remains in the electrode rode, and a residual compressive strain remains in the quartz glass layer) to some extent. Then, a temperature of the arc tube, when turned ON, does not increase up to a temperature attained when the pinch sealed portion is pinch-sealed. As a result, in the case where the residual compressive strain layer 19 is formed in the quartz glass layer over the wide range, the thermal stress generated in the quartz glass layer of the arc tube, when turned ON, acts to lower the compressive strain, which remains in advance in the glass layer of the pinch sealed portion when the arc tube is turned OFF, in both axial and circumferential directions.

Accordingly, the thermal stress (tensile thermal stress) to relax this residual compressive strain acts to the quartz glass layer in the pinch sealed portion when the arc tube is turned ON. Therefore, if the residual compressive strain layer 19 is formed in the wide range around the electrode rod 14, such residual compressive strain layer 19 relieve and absorb effectively the thermal stress that is generated in the quartz glass layer with the temperature rise because the arc tube is turned ON. In other words, because the thermal stress generated repeatedly is absorbed and scattered by the residual compressive strain layer 19, which exists over the wide range, and then transmitted to the quartz glass layer side, no crack leading to the leakage of the sealed substance is generated in the quartz glass layer.

For this reason, it is desired that the residual compressive strain layer 19 should be formed in the wide range around the base-end side area 16 of the electrode rod. In this case, if the outer diameter d2 of the electrode rod in the base-end side area 16 is too large, a difference in an amount of thermal contraction between the electrode rod and the quartz glass layer becomes large in the course of cooling of the pinch sealed portion after pinch sealing was applied. Accordingly the quartz glass layer is separated from the electrode rod at the boundary. Thus, the residual compressive strain layer 19 is not formed in the wide range and then the thermal stress generated at the boundary between the electrode rod and the quartz glass layer when the arc tube is turned ON cannot be sufficiently absorbed.

For the above reason, in the embodiment of the present invention, the residual compressive strain layer 19 can be formed in the wide range around the base-end side area 16 of the electrode rod in the pinch sealed portion 13 by forming the outer diameter d2 (e.g., 0.1 to 0.3 mm) of electrode rod in the base-end side area 16 smaller than the outer diameter d1 (e.g., 0.3 to 0.4 mm) of electrode rod in the top-end side area 15. As a result, the thermal stress generated in the quartz glass layer of the pinch sealed portion 13 when the arc tube is turned ON can be relaxed and absorbed by the residual compressive strain layer 19, and thus no crack is generated in the quartz glass layer in the pinch sealed portion 13.

Also, there are correlations as shown in FIGS. 3A and 3B between a dimensional ratio d1/d2 of the outer diameters d1, d2 in the top-end side area 15 of the electrode rod and the base-end side area 16 of the electrode rod and a crack occurring rate and an electrode breakage occurring rate. That is, the electrode breakage occurring rate is increased if the ratio d1/d2 is increased, while the crack occurring rate is increased if the ratio d1/d2 is decreased. Therefore, it is desired that, in order to suppress a defective unit occurring rate low (the crack occurring rate and the electrode breakage occurring rate are suppressed below 0.5%, for example), the ratio d1/d2 should be set in a range of 1.2 to 2.7.

Therefore, in the embodiment of the present invention, the dimensional ratio d1/d2 of the outer diameters d1, d2 in the top-end side area 15 of the electrode rod and the base-end side area 16 of the electrode rod is set in the range of 1.2 to 2.7. Therefore, both the damage of the electrode rod 14 and 15 in the closed glass globe 12 and the generation of the crack in the pinch sealed portion 13 can be suppressed.

Also, a length L of the top-end side area 15 of the electrode rod protruded into the closed glass globe 12 is set in a range of 1.0 to 2.0 mm. Therefore, improvement in the energy efficiency (lumen/W) can be achieved without damage of the electrode rod.

That is, as shown in FIG. 4, if the length L of the top-end side area 15 of the electrode rod exceeds 2.0 mm, the heat capacity of the electrode becomes too large and then consumption of the thermal energy is increased correspondingly in the top end portion of the electrode. Thus, the energy consumption as an optical energy, i.e., the energy efficiency (lumen/W) is lowered. In contrast, if the length L of the top-end side area 15 of the electrode rod is below 1.0 mm, the temperature of the electrode rises excessively because the heat capacity of the electrode is small. Accordingly, the electrode is consumed largely or the breakage is caused at the stepped portion of the electrode rod. As a result, in the embodiment of the present invention, the length L of the top-end side area 15 of the electrode rod is set in a range of 1 to 2 mm in which the energy efficiency in excess of about 90 lumen/W can be assured and the electrode is not damaged.

Also, as the method of forming the electrode rod 14 into the above predetermined stepped shape, there may be considered a method of forming one end side, which corresponds the base-end side area 16, of the cylindrical electrode rod having a uniform outer diameter d1 into a cylindrical shape having an outer diameter d2 by the cutting or the etching, and a method of jointing integrally the top-end side area 15 having an outer diameter d1 and the base-end side area 16 having an outer diameter d2, both prepared previously as a separate body respectively, by welding.

Also, as the method of manufacturing the arc tube, an electrode assembly in which the electrode rods 14, the molybdenum foils 17, and the lead wires 18 are connected integrally and linearly is formed previously. Then, this electrode assembly is inserted into an opening end portion of the glass tube in which the glass globe is shaped and then held therein, and the buffering metal halides such as Na, Sc halides and $ThI_4$ used instead of Hg, etc. are sealed together with the rare gas (Xe gas) in the closed glass globe by pinch-sealing the opening end portion of the glass tube. In this case, the particular manufacturing method of the arc tube 10 is disclosed in the JP-A-2001-15067. The residual compressive strain layer 19 to relieve and absorb the thermal stress, which is generated in the quartz glass layer of the pinch sealed portion 13 when the arc tube is turned ON, is formed over the wide range on the boundary between the electrode rod 14 and the quartz glass layer in the pinch sealed portion 13 of the manufactured arc tube 10.

Figure 5A:
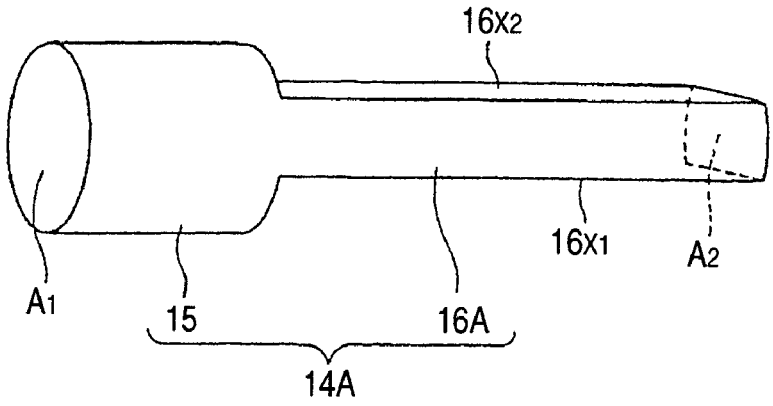
FIG. 5A is an enlarged side perspective view showing a pertinent portion of an arc tube for a discharge lamp as a second embodiment of the present invention.
Figure 5B:
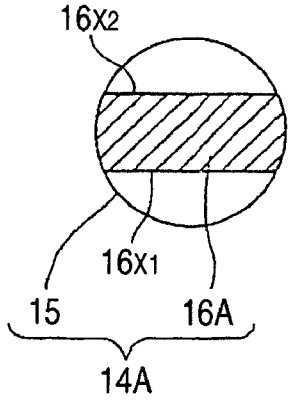
FIG. 5B is a cross sectional view of the same electrode rod shown in FIG. 5A.
Figures 6A, 6B:
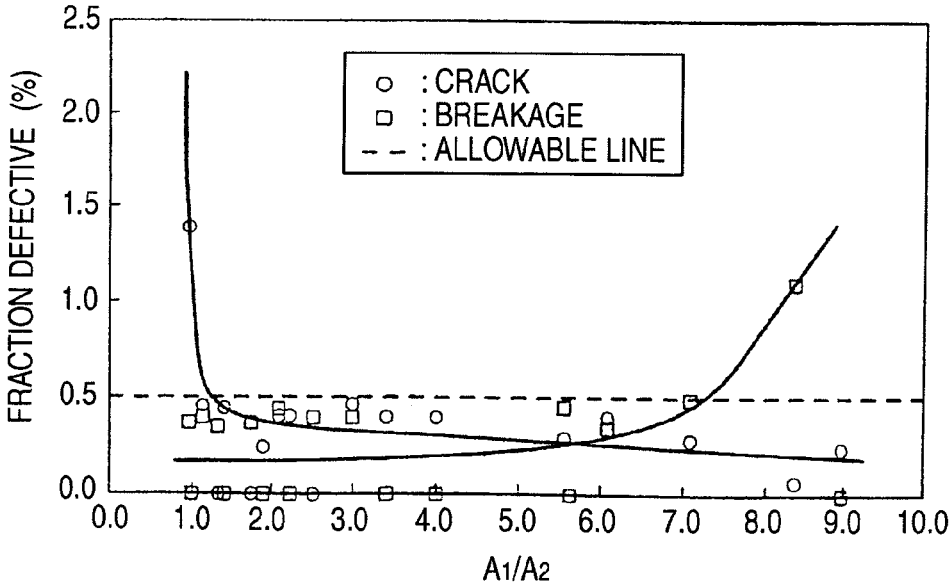
FIG. 6A is a view showing relationships of a crack occurring rate in the pinch sealed portion and the electrode breakage occurring rate to an area ratio between cross sections in the top-end side area of the electrode rod and the base-end side area of the electrode rod.
FIG. 6B is a view showing relationships of a fraction defective of the electrode rod to the area ratio between cross sections in the top-end side area of the electrode rod and the base-end side area of the electrode rod.

FIG. 5 and FIG. 6 show a second embodiment of the present invention. FIGS. 5A and 5B are an enlarged side perspective view showing a pertinent portion of an arc tube for a discharge lamp as a second embodiment of the present invention, and a cross sectional view of the same electrode rod respectively. FIG. 6A is a view showing relationships of a crack occurring rate in the pinch sealed portion and the electrode breakage occurring rate to an area ratio between cross sections in the top-end side area of the electrode rod and the base-end side area of the electrode rod. FIG. 6B is a view showing relationships of a fraction defective of the electrode rod to the area ratio between cross sections in the top-end side area of the electrode rod and the base-end side area of the electrode rod.

In the above first embodiment, the electrode rod 14 is constructed as the coaxial stepped cylindrical shape in which the outer diameter d1 in the top-end side area 15 is set large while the outer diameter d2 in the base-end side area 16 is set small. In this second embodiment, the shape of the electrode rod 14 in the top-end side area 15 is identical to the shape of the top-end side area in the first embodiment, but a shape of the electrode rod 14 in a base-end side area 16A is constructed to have a pair of opposing side surfaces 16×1, 16×2 that are formed by cutting a side surface of a circular cylinder in parallel by a same amount respectively.

Also, unlike a circle in the first embodiment, a cross sectional area of the base-end side area 16A is a deformed cross section that is close to a rectangle obtained by cutting a circle with a pair of opposing chords. Since the cross section cannot be specified by an outer diameter dimension as in the first embodiment, the correlation shown in FIG. 3 cannot be applied thereto. However, it was confirmed that there are correlations shown in FIGS. 6A and B between the area ratio A1/A2 of the cross sections in the top-end side area 15 of the electrode rod and the base-end side area 16A of the electrode rod and the crack occurring rate in the pinch sealed portion and the electrode breakage occurring rate. Therefore, the area ratio A1/A2 of the cross sections in the top end side area 15 of the electrode rod and the base-end side area 16A of the electrode rod is set based on the correlations shown in FIGS. 6A and B.

In other words, the electrode breakage occurring rate is increased if the ratio A1/A2 is increased, while the crack occurring rate is increased if the ratio A1/A2 is decreased. Thus, it is desired that, in order to suppress the defective unit occurring rate low (the crack occurring rate and the electrode breakage occurring rate are suppressed below 0.5%, for example), the ratio A1/A2 should be set in a range of 1.1 to 7.3. Therefore, in the embodiment of the present invention, the area ratio A1/A2 of the cross sections in the top-end side area 15 of the electrode rod and the base-end side area 16A of the electrode rod is set in a range of 1.1 to 7.3 which is indicated as A1/A2=1.8 in FIG. 6.

Other portions are similar to those in the above first embodiment, and their redundant explanation will be omitted herefrom by affixing the same reference symbols to them.

Also, in the above second embodiment, an example in which the cross section of the base-end side area 16A of the electrode rod is formed as the deformed sectional shape is given. As other embodiment in which the cross section of the base-end side area 16A of the electrode rod is formed as the deformed sectional shape, the case where the cross section is shaped into a part of a circle shown in FIG. 7 and FIG. 8 may be considered.

Figure 7A:
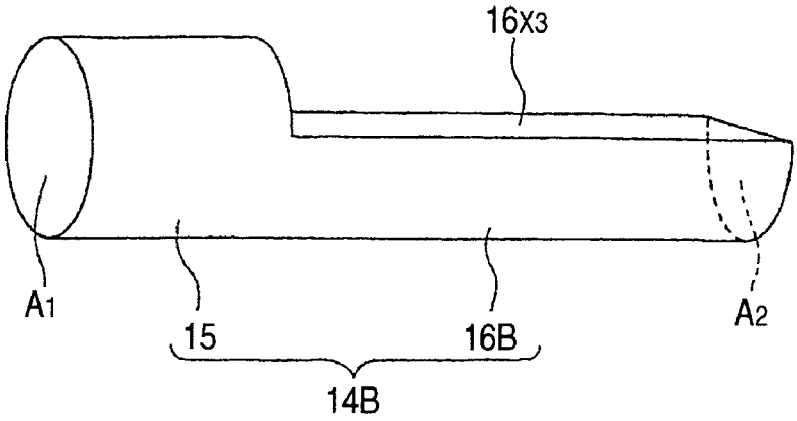
FIG. 7A is an enlarged side perspective view showing a pertinent portion of an arc tube for a discharge lamp as a third embodiment of the present invention.
Figure 7B:
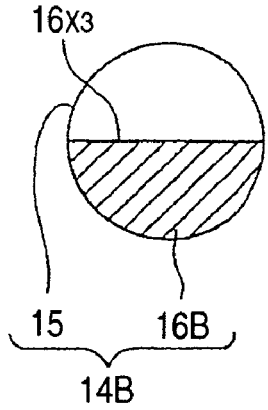
FIG. 7B is a cross sectional view of the same electrode rod shown in FIG. 7A.
Figure 8A:
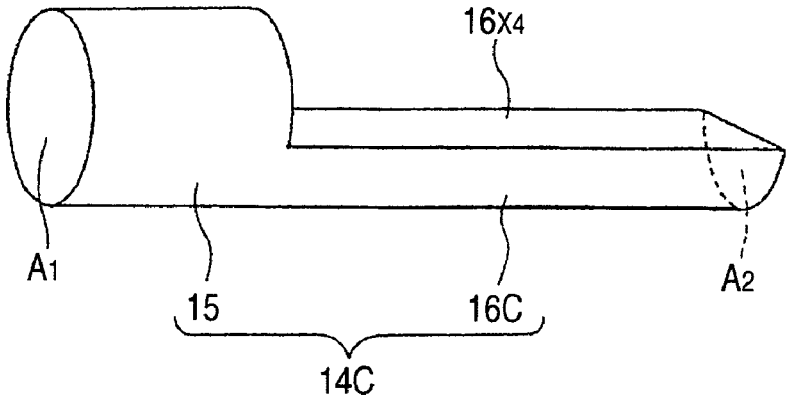
FIG. 8A is an enlarged side perspective view showing an electrode rod as a pertinent portion of an arc tube for a discharge lamp as a fourth embodiment of the present invention.
Figure 8B:
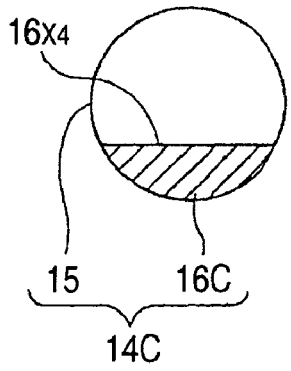
FIG. 8B is a cross sectional view of the same electrode rod shown in FIG. 8A.

In a base-end side area 16B of the electrode rod in a third embodiment of the present invention shown in FIG. 7, the cross section is shaped into a shape obtained by cutting away a cylinder up to a position just including a longitudinal axis, and a ratio A1/A2=2 is set. Also, in a base-end side area 16C of the electrode rod in a fourth embodiment shown in FIG. 8, the cross section is shaped into a shape obtained by cutting away a cylinder up to a position that exceeds a longitudinal axis, and a ratio A1/A2=4.5 is set. Reference symbols 16×3, 16×4 in FIGS. 7 and 8 denote a cutting surface respectively.

Figure 9:
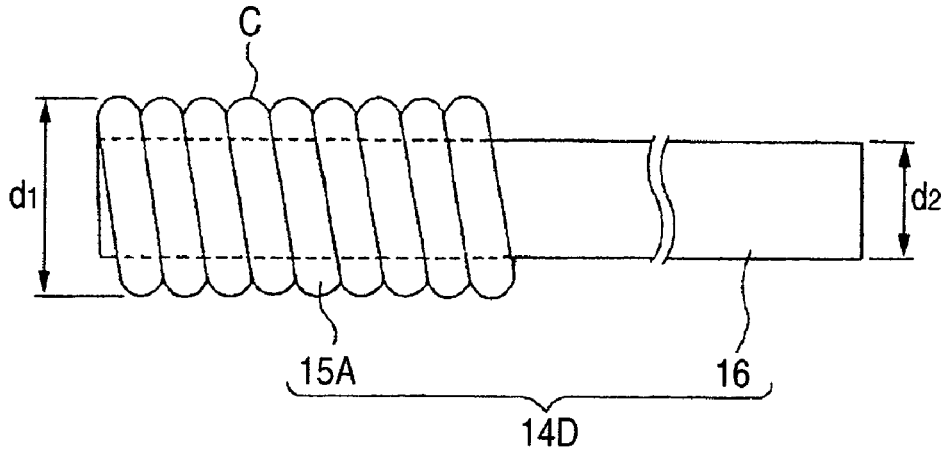
FIG. 9 is an enlarged side view showing an electrode rod as a pertinent portion of an arc tube for a discharge lamp as a fifth embodiment of the present invention.

FIG. 9 is an enlarged side view showing an electrode rod as a pertinent portion of an arc tube for a discharge lamp as a fifth embodiment of the present invention.

An electrode rod 14D in the fifth embodiment has such a structure that a tungsten coil C is fitted integrally onto the top-end side area of the main body of the tungsten electrode rod having an outer diameter d2. A ratio d1/d2 of the outer diameter d1 of the top-end side area 15A, which corresponds coil C, of the electrode rod to the outer diameter d2 the base-end side area 16 of the electrode rod is set in a range of 1.2 to 2.7.

Figure 10:
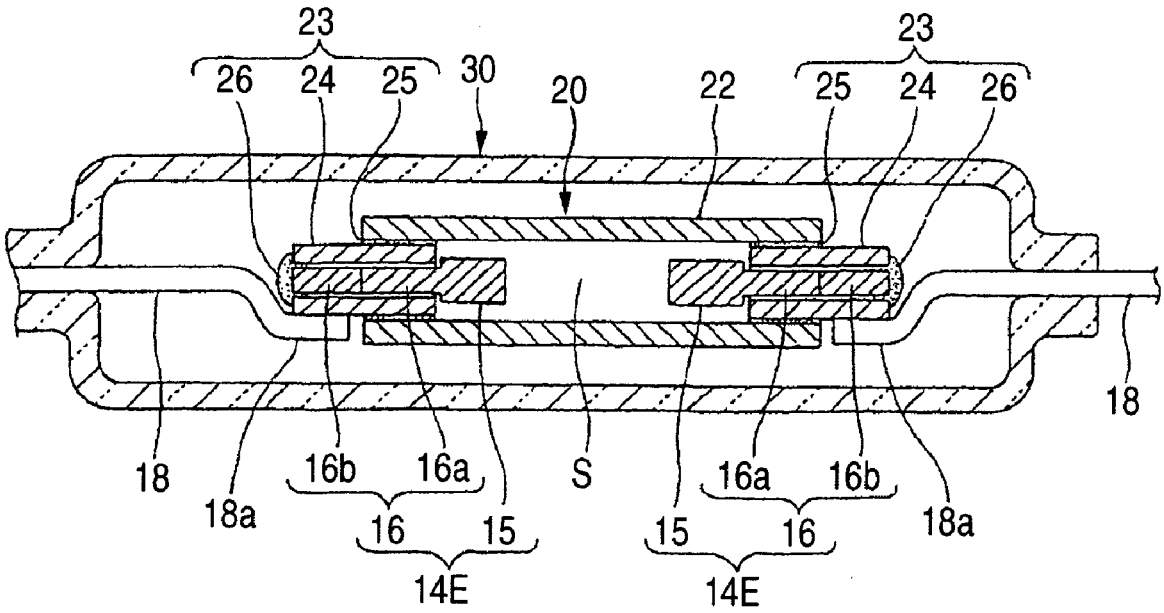
FIG. 10 is a longitudinal sectional view showing a pertinent portion of an arc tube for a discharge lamp as a sixth embodiment of the present invention.

FIG. 10 is a longitudinal sectional view showing a pertinent portion of an arc tube for a discharge lamp as a sixth embodiment of the present invention.

The lead wire 18 connected electrically to an electrode rod 14E, which is protruded in the closed space S as the closed chamber, is extended from the front and rear end portions of the arc tube 20, respectively. Both a ceramic arc tube 20 and a shroud glass 30 are assembled integrally by sealing and fitting the ultraviolet shielding shroud glass 30 onto the lead wires 18.

The arc tube 20 has such a structure that a translucent ceramic tube 22 having a right cylindrical shape is sealed at both end portions, the electrode rods 14E are provided in the ceramic tube 22 to oppose to each other, and the buffering metal halides such as the luminous substances (NaI, $ScI_3$), $ThI_4$ used instead of Hg, etc. are sealed together with the starting rare gas (Xe gas) in the closed space S. The lead wire 18 is jointed to front and rear sealed portions 23 of the ceramic tube 22 respectively to extend coaxially.

A reference symbol 24 is a molybdenum pipe used to seal opening portions on both ends of the arc tube 20 (ceramic tube 22) and secure and hold the electrode rod 14E. A reference symbol 25 is a metallized layer that is filled between an inner peripheral surface of the ceramic tube 22 and an outer peripheral surface of the molybdenum pipe 24 to joint the ceramic tube 22 and the molybdenum pipe 24 and seal the opening portions on both ends of the ceramic tube 22.

The electrode rod 14E is constructed by jointing integrally a tungsten portion 16*a* on the top end side to a molybdenum portion 16*b* on the base end side coaxially by virtue of welding. The electrode rod 14E is secured to the ceramic tube 22 via the molybdenum pipe 24 by welding the molybdenum portion 16*b* to the molybdenum pipe 24. A reference symbol 26 is a laser-welded portion. Then, a top-end bent portion 18*a* of the molybdenum lead wire 18 is secured to the molybdenum pipe 24 projected from the front and rear ends of the ceramic tube 22 by welding, so that the lead wires 18 and the electrode rods 14E are aligned on the same axis.

In other words, the sealed portions 23 of the ceramic tube 22 are constructed by jointing and securing the molybdenum pipe 24 to both end portions of the ceramic tube 22 by means of the metallize-jointing and then welding the molybdenum portion 16*b* to the molybdenum pipe 24. Therefore, the sealed portion 23 of the ceramic tube 22 signifies the end portion of the ceramic tube 22 sealed via the molybdenum pipe 24 and, in more detail, signifies the molybdenum pipe 24, the laser-welded portion 26, and the metallized layer 25. Then, the projected portion of the electrode rod 14E into the closed space S is formed of the tungsten that is excellent in the heat resistance. Also, the jointed portion of the electrode rod 14E contacted with the molybdenum pipe 24 is formed of the molybdenum that gets to well fit the molybdenum pipe. Thus, both the heat resistance of the electrode rod 14E in the discharging luminous portion and the air tightness of the ceramic tube 22 in the sealed portion can be satisfied.

Also, like the electrode rod 14 in the first embodiment, the electrode rod 14E is constructed like a stepped circular cylindrical shape in which the dimension ratio d1/d2 of the outer diameters d1, d2 in the top-end side area 15 of the electrode rod and the base-end side area 16 of the electrode rod is set in a range of 1.2 to 2.7. Therefore, the damage of the electrode rod 14E (base-end side area 16 of the electrode rod) in the ceramic tube 22 and generation of the crack at the end portion of the ceramic tube 22 can be suppressed.

In addition, the ceramic tube 22 is constructed as such a compact structure that an outer diameter is set to 2.0 to 4.0 mm, a length is set to 8.0 to 12.0 mm, and an internal volume of the closed space S put between the sealed portions 23, 23 is set to 5.0 μl or less. Therefore, not only the heat resistance and the durability can be assured but also the light can be emitted substantially uniformly from the overall arc tube 20 (ceramic tube 22).

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A mercury-free arc tube for a discharge lamp, comprising:

a closed chamber filled with rare gas and a metal halide containing at least Na halide or Sc halide, an internal volume of the closed chamber being 50 μl or less; and electrodes disposed on both end portions of the closed chamber so as to be opposed to each other, wherein the electrode rod is step-shaped which satisfies relationship of $1.1<A1/A2<7.3$, whereas A1 is a cross sectional area of the electrode in a top-end side area protruded into the closed chamber, and A2 is a cross sectional area of the electrode in a base-end side area fixed to the end portion of the closed chamber.

2. A mercury-free arc tube for a discharge lamp as set forth in claim 1, wherein a length of the top-end side area of the electrode rod is ranging from 1.0 to 2.0 mm.

3. A mercury-free arc tube for a discharge lamp as set forth in claim 1, wherein the electrode rod is stepped coaxial cylindrical shape in which a ratio (d1/d2) of an outer diameter (d1) in the top-end side area to an outer diameter (d2) in the base-end side area is ranging from 1.2 to 2.7.

4. A mercury-free arc tube for a discharge lamp as set forth in claim 1, wherein the arc tube is made of quartz glass, the closed chamber is sealed on pinch sealed portions, and the closed chamber is a closed glass globe.

5. A mercury-free arc tube for a discharge lamp as set forth in claim 4, wherein a molybdenum foil is fixed and sealed to the pinch sealed portion, and the molybdenum foil has:

a first end side connected to the base-end side area of the electrode rod; and a second end side connected to a lead wire extracted from the pinch sealed portion.

6. A mercury-free arc tube for a discharge lamp as set forth in claims 1, wherein the arc tube is made of translucent ceramic, and the closed chamber is a closed ceramic tube cylinder.

7. A mercury-free arc tube for a discharge lamp as set forth in claims 1, wherein a cross sectional shape of the top-end side area of the electrode rod is substantially circle.

8. A mercury-free arc tube for a discharge lamp as set forth in claims 1, wherein a cross sectional shape of the base-end side area of the electrode rod is substantially circle.

9. A mercury-free arc tube for a discharge lamp as set forth in claims 1, wherein a cross sectional shape of the base-end side area of the electrode rod is rectangular-like shape which is obtained by cutting off at least a part of a circle.

10. A mercury-free arc tube for a discharge lamp as set forth in claims 1, wherein a boundary portion defined between the top-end side area and the base-end side area of the electrode is step-shaped.

11. A mercury-free arc tube for a discharge lamp as set forth in claims 1, wherein a boundary portion defined between the top-end side area and the base-end side area of the electrode is taper-shaped.

12. A mercury-free arc tube for a discharge lamp as set forth in claims 1, wherein a boundary portion defined between the top-end side area and the base-end side area of the electrode is slope-shaped.

* * * * *